US006544640B1

(12) United States Patent
Miles et al.

(10) Patent No.: US 6,544,640 B1
(45) Date of Patent: Apr. 8, 2003

(54) ARTICLE ASSEMBLY STACKS

(75) Inventors: Alden R. Miles, St. Paul, MN (US); Timothy A. Mertens, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/482,550

(22) Filed: Jan. 13, 2000

Related U.S. Application Data

(62) Division of application No. 09/018,132, filed on Feb. 3, 1998, now Pat. No. 6,063,229.

(51) Int. Cl.[7] ..... B32B 7/12; B65D 75/00

(52) U.S. Cl. ..... 428/343; 428/192; 428/42.1; 428/355; 206/44.7; 206/494; 206/813; 206/425; 206/460; 206/499; 206/820; 206/821; 206/526

(58) Field of Search ..... 428/343, 192, 428/352, 353, 40.1, 41.8, 41.5, 42.1, 42.3, 355, 43; 206/44.7, 494, 813, 425, 460, 499, 820, 821, 526

(56) References Cited

U.S. PATENT DOCUMENTS

| | | | | |
|---|---|---|---|---|
| 2,215,995 A | | 9/1940 | Bellack | 101/131 |
| 2,715,975 A | | 8/1955 | Doane et al. | 216/28 |
| 2,889,029 A | | 6/1959 | Ridenour | 198/35 |
| 2,925,167 A | | 2/1960 | Lindberg | 198/35 |
| 3,691,140 A | | 9/1972 | Silver | 260/78.5 |
| 3,857,731 A | | 12/1974 | Merrill, Jr. et al. | 117/122 |
| 4,166,152 A | | 8/1979 | Baker et al. | 428/522 |
| 4,664,416 A | | 5/1987 | Steidinger | 282/11.5 A |
| 4,786,696 A | | 11/1988 | Bohnel | 526/88 |
| 4,930,812 A | | 6/1990 | Howard | 281/5 |
| 4,938,414 A | * | 7/1990 | Lippert | 229/92.8 |
| 4,938,507 A | | 7/1990 | Ashby et al. | 282/9 R |
| 4,971,364 A | | 11/1990 | Templet | 283/70 |
| 4,980,212 A | | 12/1990 | Marquis et al. | 428/40 |
| 4,988,567 A | | 1/1991 | Delgado | 428/402 |
| 4,994,322 A | | 2/1991 | Delgado et al. | 428/343 |
| 4,995,641 A | | 2/1991 | Landry et al. | 283/67 |
| 5,029,903 A | | 7/1991 | Pennock | 283/81 |
| 5,045,569 A | | 9/1991 | Delgado | 521/60 |
| 5,087,223 A | | 2/1992 | Kaluza | 462/2 |
| 5,194,299 A | | 3/1993 | Fry | 427/208.6 |

(List continued on next page.)

FOREIGN PATENT DOCUMENTS

| | | |
|---|---|---|
| EP | 0 341 524 | 11/1989 |
| WO | WO 92/16447 | 10/1992 |
| WO | 94/14614 | 7/1994 |

OTHER PUBLICATIONS

United States Statutory Invention Registration, Greig, Registration No. II377, published Dec. 1, 1987.

*Primary Examiner*—Terrel Morris
*Assistant Examiner*—Hai Vo
(74) *Attorney, Agent, or Firm*—Michaele A. Hakamaki; George W. Jonas

(57) ABSTRACT

A method of applying repositionable pressure-sensitive adhesive sheets to moving articles includes aligning a plurality of articles for sequential movement through a sheet application station. Each article has at least two different sheet landing areas defined on a common surface thereof A repositionable pressure-sensitive adhesive sheet from a first applicator is applied at the sheet application station onto a first landing area of every other article as it passes the sheet application station. A repositionable pressure-sensitive adhesive sheet from a second applicator is applied onto a second different landing area on all of the remaining articles as they pass through the sheet application station. The resultant stack of articles formed in this way does not have all of the note sheets aligned vertically in the stack, thus reducing the overall height of the stack by dispersing horizontally the added thicknesses of the note sheets on the articles.

20 Claims, 5 Drawing Sheets

U.S. PATENT DOCUMENTS 5,299,833 A 4/1994 Madole, Jr. ..... 281/2
5,316,344 A 5/1994 Popat et al. ..... 283/81
5,324,078 A 6/1994 Bane ..... 283/81
5,328,409 A 7/1994 Marquardt ..... 462/17
5,382,055 A 1/1995 Mertens et al. ..... 283/67
5,390,819 A * 2/1995 Kaye ..... 221/45
5,399,403 A 3/1995 Instance ..... 428/40
5,618,062 A 4/1997 Mertens et al. ..... 283/67
5,755,355 A * 5/1998 Timmerman et al. ..... 221/33
5,782,494 A 7/1998 Crandall et al. ..... 281/2
6,153,278 A * 11/2000 Timmerman et al. ..... 428/40.1
6,406,244 B1 * 6/2002 Le Riche ..... 412/37

* cited by examiner

ARTICLE ASSEMBLY STACKS

This is a divisional application Ser. No. 09/018,132, filed Feb. 3, 1998 now U.S. Pat. No. 6,063,229.

BACKGROUND OF THE INVENTION

The present invention relates to the application of repositionable pressure-sensitive adhesive sheets to articles such as advertising media, newspapers, envelopes or the like and the resultant stacked assemblies of such materials.

Repositionable note sheets, such as the Post-it® brand notes sold by Minnesota Mining and Manufacturing Company of St. Paul, Minn., are quite common and in every day use. Such note sheets in familiar form are available in stacks or pads of sheets, one adhered to another. A repositionable note sheet has a first side which is partially coated with a repositionable pressure-sensitive adhesive (RPSA) and a second side which is either plain (no printing) for writing a note, or which may have a preprinted message or design thereon. Such a repositionable note sheet is usefull for calling attention to a particular section of a document, for marking a page in a document or book, or for leaving a removable and repositionable note that can be adhered to just about any clean surface.

Advertising materials using repositionable note sheets on print media have been produced in the fields of direct-mail advertising, newspapers, magazines, advertising signatures, and the like. The note sheets are repositionable so that they can be removed from those advertising materials and adhered at another location (for example, a desk or refrigerator) to remind the reader to call the advertiser or to use the note sheet as a coupon at a later date.

Advertising articles bearing note sheets are typically produced by sequentially applying the note sheets in the same location on a series of printed advertising pieces. For example, newspapers and magazines have been printed and assembled in their entirety, or in sections thereof (e.g., advertising signatures), and then note sheets have been sequentially applied to the same location on a particular page of the newspaper or magazine. Direct mail advertising materials have also been produced which include a repositionable pressure-sensitive note sheet. Typically, such direct-mail advertising pieces are produced using a web of paper on which is printed multiple repeating direct-mail messages, and a note sheet is sequentially attached in generally the same location on each of those repeating messages on that web. The web is then cut into discrete direct-mail piece materials for further processing.

RPSA note sheets have been previously applied by hand to advertising materials and newspapers. Apparatus for automated application of RPSA note sheets to certain articles have been developed by Minnesota Mining and Manufacturing Company, and are disclosed in co-pending U.S. patent application Ser. Nos. 08/095,722, filed Jul. 21, 1993, now abandoned and Ser. No. 08/729,780, filed Oct. 8, 1996, now U.S. Pat. No. 6,383,591 both commonly owned by the assignee of the instant application, 3M Innovative Properties Company, and incorporated herein by reference.

Another common method to advertise in the newspaper industry is to apply a small pressure-sensitive adhesive (PSA) label on the masthead of the newspaper. The newspaper *USA Today* pioneered this approach. For example, a small PSA label (approximately 0.5 inch (1.25 cm) high and about 1 inch (2.5 cm) across) may be applied to promote the name of a hotel providing a complimentary *USA Today* newspaper to its overnight guests. It has been reported that these PSA labels have been applied to newspapers at speeds of 45,000 units per hour, as applied along the shorter dimension of the label in the machine direction. This approach has proved to be an effective advertising technique, but has the disadvantage that the labels (bearing a non-repositionable or permanent PSA) destroy the underlying print of the newspaper and cannot be repositioned or removed. Newspaper space is premium advertising space, particularly when the space is on the top half of the front page of a newspaper. This is because newspapers are typically distributed in a folded configuration, with the top half of the front page of the newspaper being the first portion of the newspaper which the reader or potential purchaser sees. The use of a PSA label having a permanent adhesive eliminates the possibility of the area under the label being used for effective advertising, since it is completely and permanently covered. Hence, an advantage to using repositionable pressure-sensitive adhesive note sheets on newspapers for advertising purposes is that the note sheet may be removed, thereby allowing the reader to be exposed to the information thereunder.

In addition to the fact that the PSA label permanently defaces the front of the newspaper and cannot be removed easily, the use of a label has other drawbacks. Since the labels are applied sequentially and in the same location on the top half of the front page of a folded newspaper, the same information is always covered on every newspaper. As mentioned, the value of newspaper space is quite high, and the newspaper must therefor trade the value of having a label versus the value of the printing on the underlying face of the newspaper page. In addition, the sequential PSA label application operation limits the machine-direction length of the pressure-sensitive adhesive label stock. The application of a label having a larger machine-direction length would slow the production of the newspapers. For example, sequentially applying a label having a three-inch (7.5 cm) machine-direction length would cause the overall production of newspapers to fall by two-thirds in order to allow the labeling operation to keep pace. This slowing of production is an unacceptable consequence of trying to provide a larger PSA label on a newspaper.

Labels are not note sheets. Labels are generally completely covered on one side with pressure-sensitive adhesive and generally are intended to transmit information, not to be removed by the recipient and not to be put to further use (e.g., as a reminder or coupon). Note sheets, however, are used to draw attention to information, and can be removed and subsequently repositioned many times. Consequently, 3M Post-it® brand notes are ubiquitous tools in the office, and are now often found sticking around the home as well.

The application of a label or note sheet to the front page of a folded newspaper does not have any appreciable effect on the thickness of the folded newspaper. However, that is not necessarily the case when a note sheet or label is applied to a single page or to an advertising signature comprising just a few pages. When a thin article or single page bearing a note sheet is collated and assembled in stacked form, with the note sheet placed in an identical location on each item, it can make a significant difference in the height of the stack of such assemblies (e.g., even doubling it), depending on the relative thicknesses of the items and note sheets. This is problematic for later processing of such article assemblies, since one portion or corner of the stack may have a significantly greater height than other portions thereof This can cause misfeeds in further printing, collating or folding apparatus for handling the stack of article assemblies.

A method used to provide a pressure-sensitive mailing label attached to a letterhead has been commercialized by Avery Corporation, and is disclosed in U.S. Pat. No. 5,316,344. A stack of bond paper was provided for printing, with each sheet of paper having attached thereto a removable pressure-sensitive adhesive label. Each label throughout the stack was in generally the same location on each sheet of paper. While this is a convenient method to simultaneously print letters and associated labels, it has the disadvantage of causing a portion of the stack to be much higher than the rest of the stack. Because the label has roughly the same thickness as the bond paper, the area carrying the label bulges much higher than the rest of the stack. This can result in misfeeds by common copiers or digital printers, which are otherwise designed to feed from a stack having relatively straight and aligned sides. Finally, because all of the labels are generally vertically aligned throughout the stack, about only half as many sheets may fit into a feeding tray as normal. Frequent stopping of production is then necessary in order to refill the paper trays.

Digital printing and copying devices are becoming more popular to produce varieties of materials, from direct-mail literature to catalogs. By using digital printing and copying devices, the printing on each sheet can take a different form or orientation to achieve customer desires. Consequently, duplex printing, and alternating images to meet the demands of unique media, are well known and supported in the print media industry.

BRIEF SUMMARY OF THE INVENTION

A method of applying repositionable pressure-sensitive adhesive sheets to moving articles, wherein each article has at least two different sheet landing areas defined on a common surface thereof, includes aligning a plurality of those articles for sequential movement through a sheet application station. A first set of articles is defined as every other article, and a second set of articles is defined as all remaining articles. A repositionable pressure-sensitive adhesive sheet is applied from a first applicator at the sheet application station onto a first landing area on each article of the first set of articles, and a repositionable pressure-sensitive adhesive sheet from a second applicator at the sheet application station is applied onto a second, different landing area on each article of the second set of articles.

Preferably, the moving articles are folded newspapers aligned in a linearly shingled configuration, with the common surface being a top half of a first page of each folded newspaper. Each folded newspaper also preferably has indicia printed on its sheet landing area which is at least partially covered by the repositionable pressure-sensitive adhesive sheet adhered thereto. Each repositionable pressure-sensitive adhesive sheet has a repositionable adhesive thereon which permits subsequent removal of the sheet from the folded newspaper without damage to the indicia on the newspaper within that sheet's landing area. Preferably, the folded newspapers are advanced in a longitudinal direction at a rate of 45,000 newspapers per hour, and each repositionable pressure-sensitive adhesive preferably has a longitudinal extent of about three inches (7.5 cm).

In a preferred embodiment, the articles are advanced in a first direction, and each applicator applies the repositionable pressure-sensitive adhesive sheets therefrom onto the articles in the same first direction. In one embodiment, the repositionable pressure-sensitive adhesive sheets bear preprinted indicia thereon. In an alternative embodiment, the articles are advanced in a longitudinal direction, and the first and second applicators are spaced laterally and longitudinally relative to the common surface of each of the advancing articles.

The landing areas on the common surface of each of the articles are preferably discrete, non-overlapping areas relative to one another. In one preferred embodiment of the inventive method, the articles of the first set are reversed in orientation relative to the articles of the second set during advancement thereof through the sheet application station. The repositionable pressure-sensitive sheets applied by the first applicator are reversed in orientation relative to the repositionable pressure-sensitive adhesive sheets applied by the second applicator. Preferably, the inventive method includes collating the articles of the first and second sets into a sequence of articles having identical orientation. The inventive method alternatively preferably includes printing indicia on the common surface of each article and the repositionable pressure-sensitive adhesive sheet adhered thereto. Further processing of the printed articles and associated repositionable pressure-sensitive adhesive sheets adhered thereto may include collating them into a sequence of articles having identical orientations.

In one embodiment of the present invention, a stack of identical article assemblies includes a plurality of generally planar identical articles, each article having front and back opposite major faces and top and bottom edges. A plurality of identical repositionable pressure-sensitive adhesive sheets are provided, with each sheet being adhered in an identical location and orientation on the front major face of a respective one of the articles. The back major face of each article in the stack lies on the front major face of the article therebelow, and every other article in the stack is turned 180° so that the top edge of each article in the stack extends along the bottom edge of the article therebelow, and the repositionable pressure-sensitive adhesive sheets of contiguous articles are oppositely aligned and do not overlap. Preferably, each article is a single paper sheet.

In another embodiment of the present invention, a stack of identical article assemblies has a plurality Of generally planar identical articles, with each article having front and back opposite major faces and top and bottom edges. A plurality of identical repositionable pressure-sensitive adhesive sheets is provided, and each sheet is adhered in an identical location and orientation on the front major face of a respective one of the articles. The articles are aligned in stacked pairs, with the back major face of one article in each pair lying on the front major face of the other article in that pair. One article in each pair turned 180° on a vertical axis with respect to the other article in that pair so that the top edge of one article extends along the bottom edge of the other article. The repositionable pressure-sensitive adhesive sheets of the articles in each pair are oppositely aligned and do not overlap. Every other pair of articles in the stack is flipped over 180° on a horizontal axis so that contiguous articles from adjacent pairs in the stack lie front major face to front major face and back major face to back major face, alternately throughout the stack. Preferably, each article is a single paper sheet.

BRIEF DESCRIPTION OF THE DRAWINGS

The present invention will be further explained with reference to the drawing figures listed below, wherein like structure is referred to by like numerals throughout the several views.

While the above-identified drawing figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention. It should be specifically noted that the figures have not been drawn to scale, as it has been necessary to enlarge certain portions for clarity.

DETAILED DESCRIPTION OF THE PREFERRED EMBODIMENTS

In describing the preferred embodiments of the invention, specific terminology will be used for the sake of clarity. The invention, however, is not intended to be limited to the specific terms so selected, and it is to be understood that each term so selected includes all the technical equivalents that operate similarly.

Figure 1:
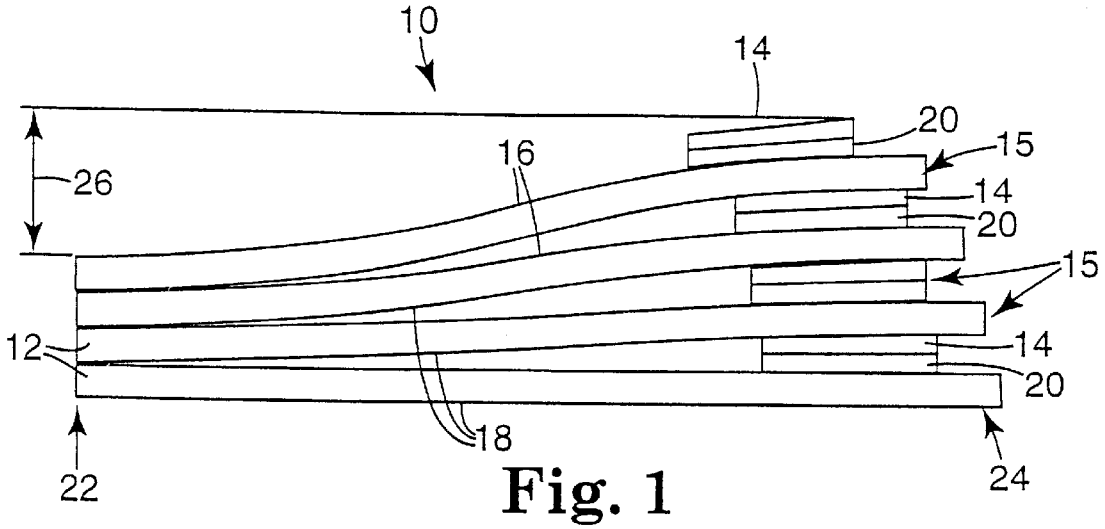
Fig. 1 (PRIOR ART)
FIG. 1 is a schematic side view of a stack of single sheet pages, each having a label applied thereto in generally overlapping relation throughout the stack.

FIG. 1 is illustrative of the problem of applying adhesive labels or note sheets on the same location to a single page which has been stacked for further processing. A stack 10 of single sheet pages 12 is shown. Each page 12 has a label 14 applied thereto to define an article assembly 15. The label 14 of each article assembly 15 is mounted on a front major face 16 of its respective page 12. Each page 12 also has an opposite, back major face 18, and the pages 12 are stacked with the back major face 18 of each page 12 lying over the front major face 16 of each page 12 therebelow. Each label 14 has its entire back side coated with a pressure-sensitive adhesive 20.

The pages 12 in the stack 10 are aligned along an alignment edge 22, and are stacked so that the labels 14 are generally vertically aligned over each other, as shown in FIG. 1. The difference in the article assembly 15 thickness across the face thereof caused by the label 14 results in the stack 10 having a shingled edge 24 opposite the alignment edge 22. The difference in thickness of the stack 10 of article assemblies 15 from the alignment edge 22 to the shingled edge 24 is illustrated by off-set dimension 26.

A stack of article assemblies of the type illustrated in FIG. 1 can present problems for further handling. Sheet handling equipment is typically arranged to handle uniform stacks of sheets, having all edges aligned generally vertically, and with each stack having a uniform height dimension throughout. The variance along shingled edge 24 and the height dimension offset 26 can lead to misfeeds and jamming of the equipment which is handling the stack 10. In addition, paper trays for copying or printing equipment typically have a discrete depth. The addition of the labels 14 and the consequent added height for a stack of article assemblies 15 reduces the number of article assemblies that can be loaded into such a tray, thereby requiring more frequent reloading.

Figure 2:
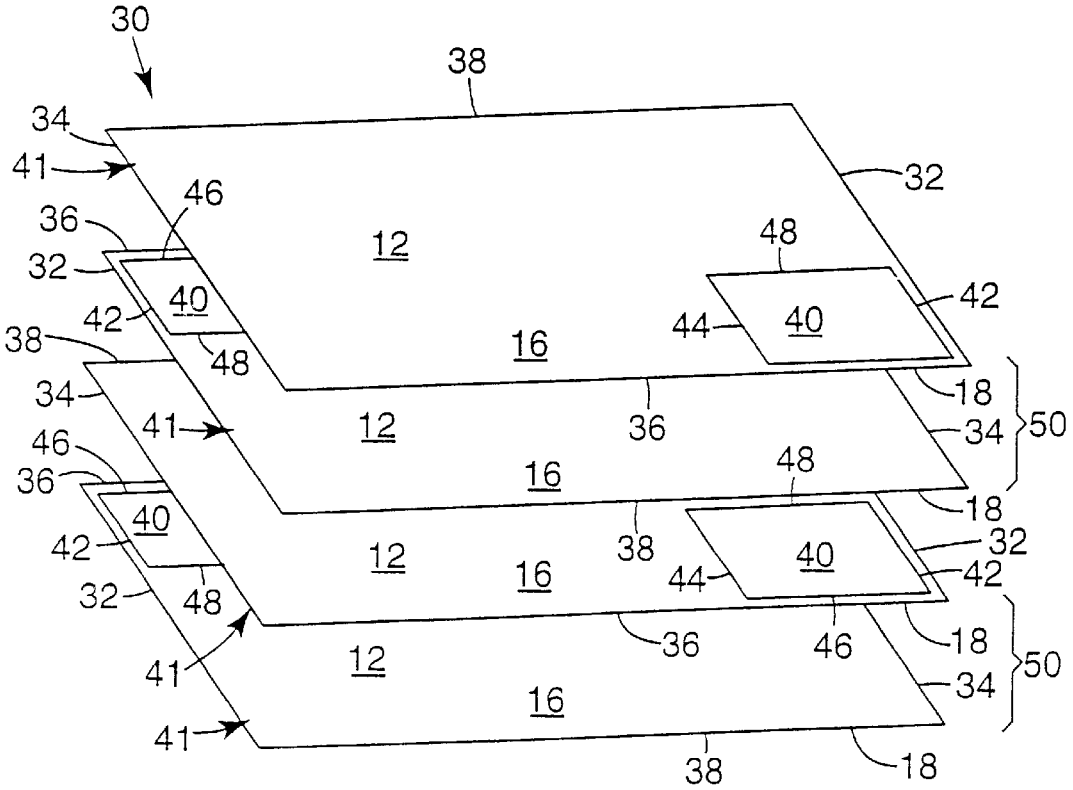
FIG. 2 is a perspective view illustrating a stack of single sheet pages, with the pages spaced vertically apart for illustrative purposes, and with each page bearing a repositionable pressure-sensitive note sheet in a corner of the page.

FIG. 2 illustrates, in exploded fashion, an inventive stack of article assemblies of the present invention. A stack 30 of the single sheet pages 12 is illustrated in spaced vertical perspective. As before, each page 12 has a front major face 16 and aback major face 18. Each page 12 also has a top edge 32, a bottom edge 34, a first side edge 36 and a second side edge 38. Preferably, each page 12 is identical, and has a likewise identical repositionable pressure-sensitive note sheet 40 adhered thereto, so that each page 12 and note sheet 40 combination defines an article assembly 41. The note sheet 40 is adhered on the front major face 16 of each page 12 in an identical location, relative to its edges 32, 34, 36 and 38. Each note sheet 40 has a top edge 42, bottom edge 44, first side edge 46 and second side edge 48. In the embodiment illustrated in FIG. 2, the top edge 42 of the note sheet 40 is aligned adjacent the top edge 32 of its respective page 12, and the first side edge 46 of the note sheet 40 is aligned adjacent the first side edge 36 of its respective page 12.

Figure 3:
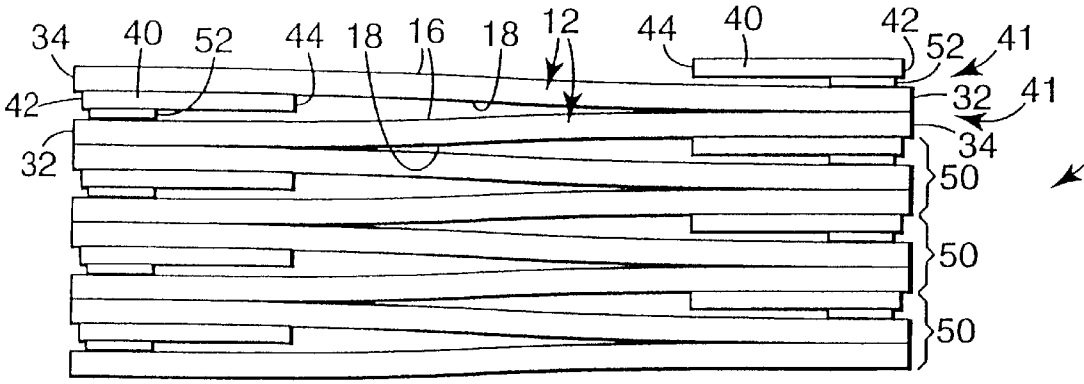
FIG. 3 is a schematic side view of the stack of pages and note sheets of FIG. 2.

Every two pages 12 represent a vertically first repeating unit 50 in the stack 30. One page 12 of each first repeating unit 50 is turned 180° on a vertical axis so that its top edge 32 extends along the bottom edge 34 of the other page 12 of that repeating unit 50. This orientation is replicated in each of the repeating units 50 so that the note sheets 40 of contiguous pages 12 do not vertically overlap in the stack 30. This has the effect of spreading out the added thickness of the note sheets 40 among the stack 30, so that they are not all aligned in an overlapped stacked relationship. FIG. 3 further illustrates this result, showing a schematic side view of the stack 30 of article assemblies 41. The note sheet 40 of each article assembly 41 has repositionable pressure-sensitive adhesive 52 partially coating a back side thereof, typically adjacent its top edge 42.

Figure 4:
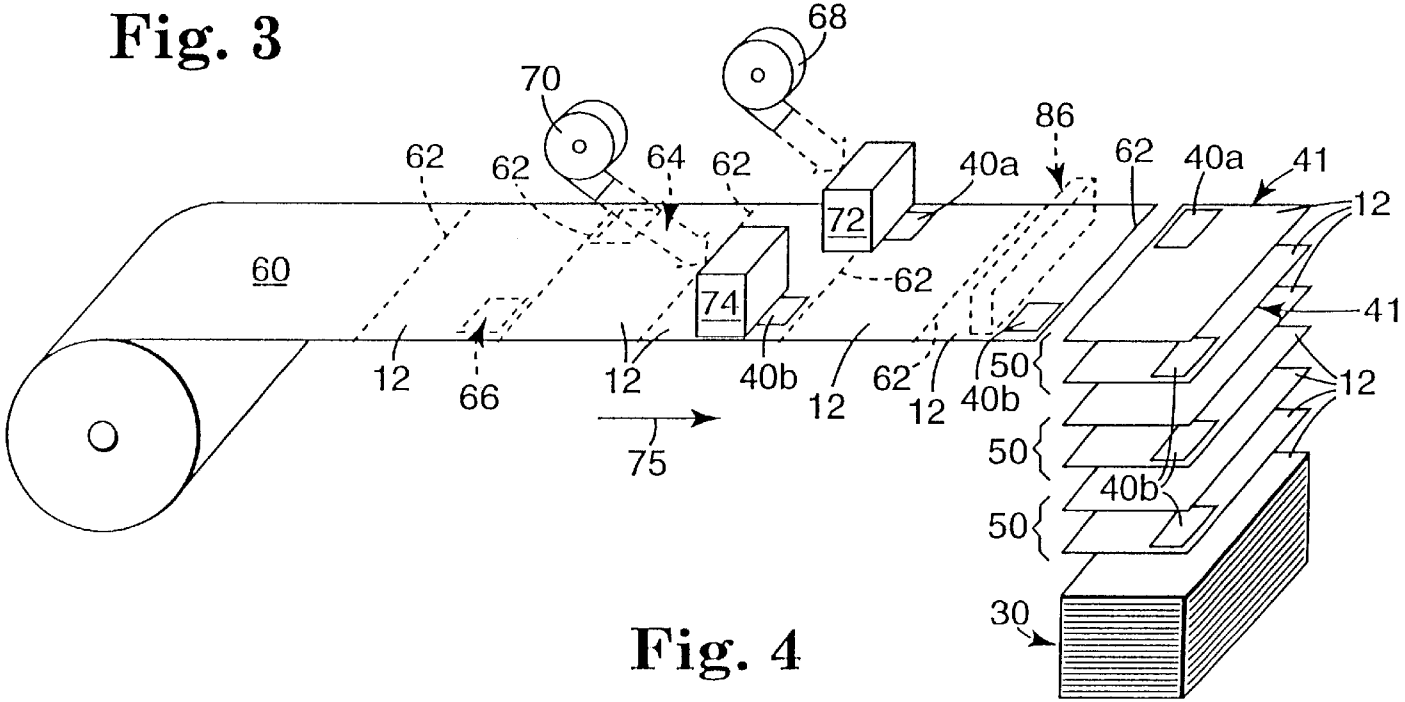
FIG. 4 schematically illustrates a process for application of note sheets to pages, to form the stack illustrated in FIGS. 2 and 3.

One exemplary arrangement for forming a stack 30 as illustrated in FIGS. 2 and 3 is schematically set forth in FIG. 4. A web 60 of sheet material is unwound and processed to form the discrete single sheet pages 12, when cut laterally along cut lines 62. Note sheet landing areas 64 and 66 are defined on the web 60 relative to the ultimate edges of the pages 12 to be cut therefrom. The landing areas 64 and 66 are preferably discretely located relative to each other, both laterally and longitudinally on the web 60. The landing area 64 is defined and aligned for reception of a note sheet 40*a* for every other page 12, while the landing area 66 is defined and aligned for reception of a note sheet 40*b* for the remainder of the pages 12.

The note sheets 40*a* and 40*b* may be applied to the web 60 by any suitable means. Preferably, however, the note sheets are applied by applicators such as those disclosed in co-pending U.S. patent application Ser. No. 08/095,722 filed Jul. 21, 1993, now abandoned Ser. No. 08/729,780 filed Oct. 8, 1996, now U.S. Pat. No. 6,383,591 of Minnesota Mining and Manufacturing Company. As such, note sheet stock is provided in roll form (such as rolls 68 and 70). The note sheet stock from each roll 68 and 70 is registered, cut and applied (via the repositionable pressure-sensitive adhesive on the note sheet stock) onto the landing areas 64 and 66 by a first applicator 72 and a second applicator 74, respectively. The applicators 72 and 74 apply the note sheets 40*a* and 40*b* in the same direction of travel as the web 60 is traveling, as indicated by arrow 75. The applicators 72 and 74 position the note sheets 40*a* and 40*b* on the web 60, and specifically on the landing areas 64 and 66, respectively, and in registry with what will ultimately be the edges of each page 12 once it has been severed from the web 60. After such cutting, the resultant discrete pages 12 (now article assemblies 41) are then stacked in a stack 30, as illustrated in FIG. 4 (and in FIGS. 2 and 3). Because of the lateral offset of the applicators 72 and 74 across the web 60, and the specific placement of note sheets 40*a* and 40*b* on the pages 12, the note sheets are placed in a manner so that all note sheets do not overlap when stacked, thereby reducing the overall height of the stack of article assemblies 41.

Figure 5:
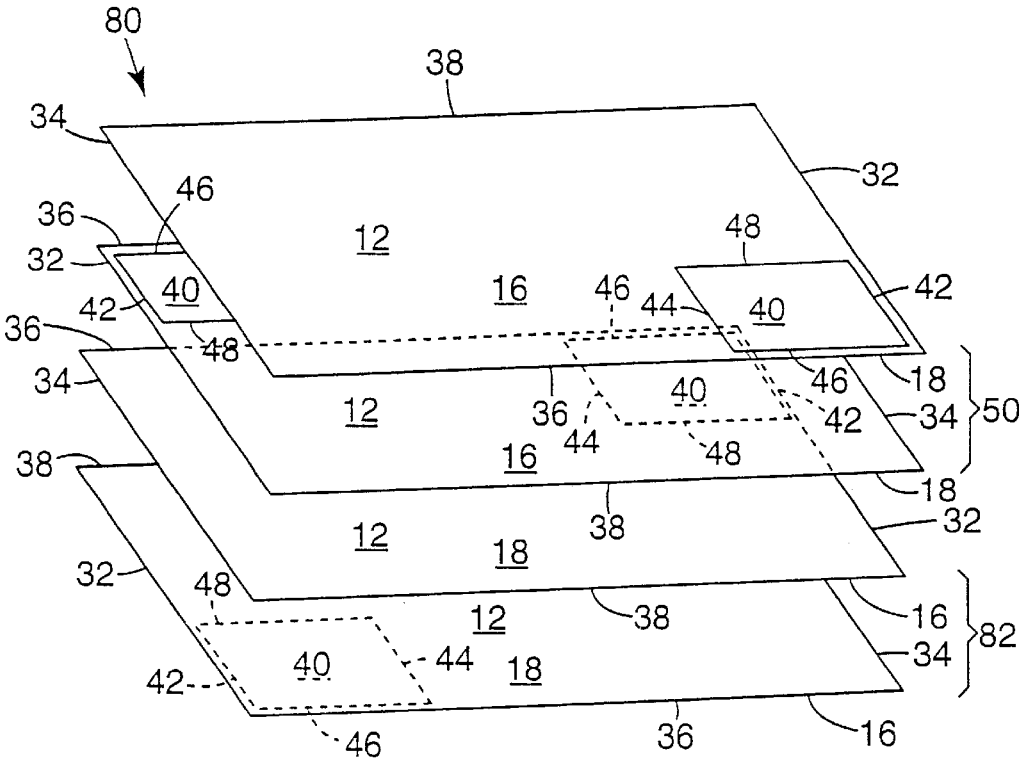
FIG. 5 is a perspective view of an alternative stack of single sheet pages, with the pages spaced vertically apart for illustrative purposes, and with each page bearing a repositionable pressure-sensitive note sheet in a corner of the page.
Figure 6:
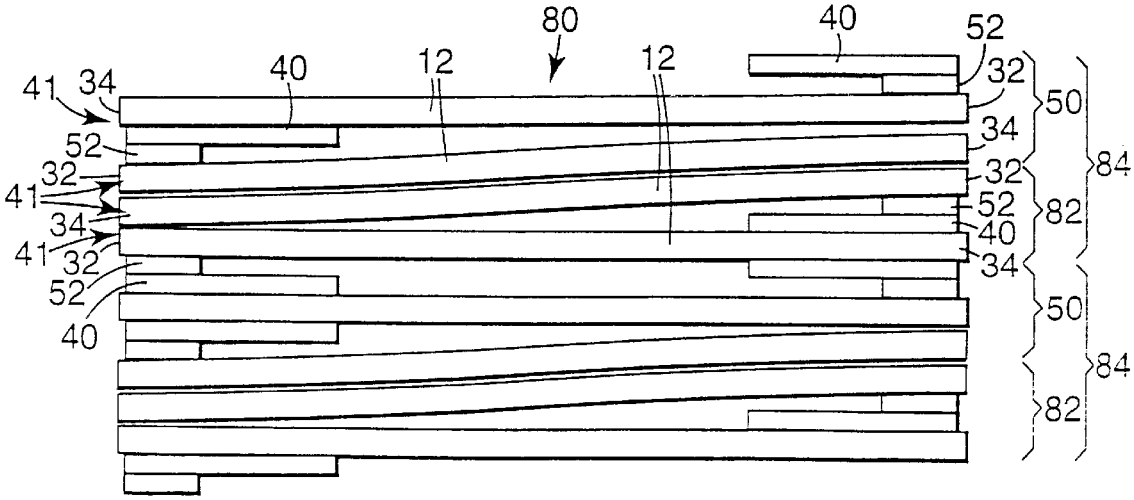
FIG. 6 is a schematic side view of the stack of pages and note sheets of FIG. 5.

FIGS. 5 and 6 illustrate an alternative stacking arrangement of the present invention for the article assemblies 41. In a stack 80 of article assemblies 41, each note sheet 40 is again aligned in the same location on its respective page 12 (relative to the edges of the page 12 and note sheet 40). Within each repeating unit 50, the orientation of the two pages in that repeating unit 50 is the same (i.e., one page 12 turned 180° relative to the other). However, every other repeating unit 50 is flipped over 180° on a horizontal axis and, as modified, is referenced as second repeating unit 82. Thus, not all contiguous pages 12 in the stack 80 are aligned front face to back face. Some contiguous pages 12 are aligned back face to back face, while others are aligned front face to front face. Each combination of a repeating unit 50 and adjacent repeating unit 82 thus defines a third repeating unit 84 throughout the stack 80, as illustrated in FIG. 6. Each third repeating unit 84 is formed from four of the article assemblies 41, with each article assembly 41 having a different alignment within the stack 80 so that none of the note sheets 40 within one of the third repeating units 84 are aligned over each other vertically. In other words, the note sheets 40 of the article assemblies 41 in the third repeating unit 84 are all positioned in discrete locations horizontally across the stack 80. Forming a stack of article assemblies 41 such as stack 80 disperses the note sheets 40 throughout the stack 80 into four overlapping columns, preferably one adjacent each corner of the stacked pages 12. This reduces the overall height of the stack 80 for storage and further handling.

The stack 80 may be formed either by collating cut pages 12 after an initial formulation of the article assembly 41, or by providing additional note sheet applicators. For instance, the note sheet applicators 72 and 74 are illustrated on a top side of the web 60. Additional applicators could be provided on the bottom side of the web 60 to place cut note sheets 40 thereon, so that once pages 12 are cut from the web 60, the note sheets are already applied and aligned in position as illustrated in FIG. 5.

The web 60 may be preprinted (printed prior to being cut into discrete pages 12) or may be blank. Likewise, the note sheet stock may also be preprinted or blank In the case of a preprinted web, the landing areas 64 and 66 for cut note sheets 40*a* and 40*b*, respectively, are specifically placed to highlight the note sheet, and perhaps to reveal a follow-on message or other indicia printed on the page therebelow (on the landing area, which is initially covered by the preprinted repositionable note sheet but uncovered when the note sheet is removed). In other words, the indicia on the note sheet 40 and the indicia on the page 12 are specifically designed to coordinate and complement each other, and thus the registry of the note sheet 40 on the page 12 is very important.

In the case where the web 60 is blank (not preprinted) and the note sheet stock is blank (not preprinted), the resultant article assemblies are thus blank and ready for further printing or processing. For example, a printing station 86 (FIG. 4) may be positioned downstream of the applicators 72 and 74 (either before or after the pages 12 are cut from the web 60) to apply text and/or other indicia to the article assembly 41. For the formation of a stack of article assemblies 41 like stack 80 (FIGS. 5 and 6), another printing station (not shown) would be provided on the opposite side of the web 60. The processing of a stack 30 or stack 80 of blank article assemblies 41 in a simple photocopier would not likely be acceptable since the photocopying would be the same on each upper side of each page, and (for duplex copying) the same on each lower side of each page, regardless of where (or on what side) the note sheet was on each page. However, with digital printing and copying capabilities, it is possible to place the same image in a desired orientation on differently disposed articles, such as in the stack of article assemblies 41 of FIG. 2. For every other sheet, the digital printer or copier would simply rotate the desired image 180° about a vertical axis so that the top of the image being printed would always be aligned with the top edge 32 of the page being printed on. The image could be applied to both page and note sheet thereon simultaneously. Likewise, a digital printer or copier could accommodate the stack 80 shown in FIG. 5. For example, the image could always be placed on the front major face 16 and aligned adjacent the top edge 32 of each page 12 (and on the note sheet 40 and aligned adjacent its top edge 42). This is the case even though the front major face 16 is, at times, flipped over for some pages and the top edge is at opposite ends of the stack from page to page.

The commercially available digital printing and copying apparatus are so versatile as to accept not only the types of material stacks 30 and 80 illustrated herein but also to accommodate stacks of material much more varying in content. For example, note sheets of different sizes and a variety of different placement locations and orientations could be preprogrammed into a digital printer. As long as the digital printer knows what sequence of article assemblies 41 to anticipate, it can lay down the desired printed image on each article assembly 41. The programming and arrangement of digital printing and copying devices is well known in the art, and one example of a digital copier having the capabilities discussed herein is the Docu-Tech machine available from Xerox Corporation, Stamford, Conn. Whatever arrangement of note sheets is made on the pages of a stack, it is intended, via the present invention, to distribute the note sheets among the stack, both vertically and horizontally, to reduce overall stack height and facilitate further handling of the article assemblies therein.

Figure 7:
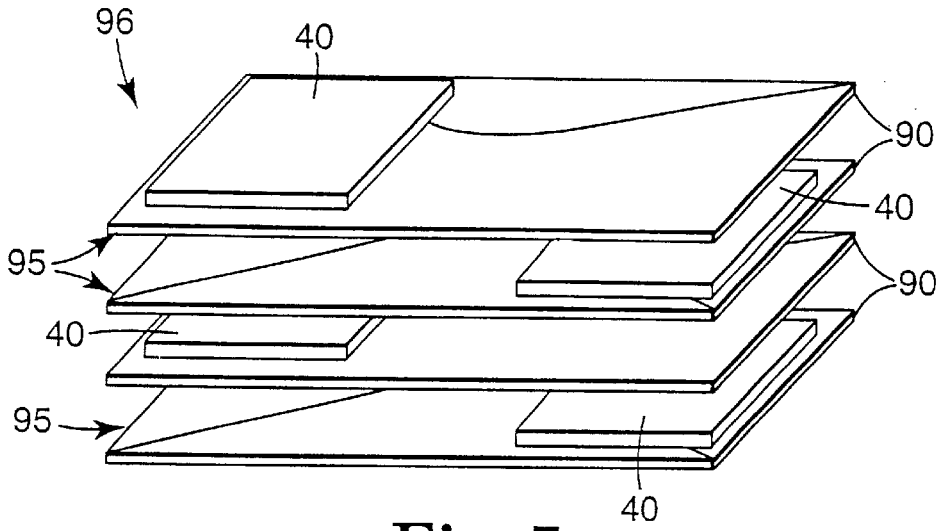
FIG. 7 illustrates, in perspective, another alternative embodiment for the inventive stacked arrangement of article assemblies, wherein the underlying substrates are envelopes.

Another embodiment of an inventive stack of the present invention is illustrated in FIG. 7. In this embodiment, the base substrate is defined as an envelope 90. Each envelope has a note sheet 40 adhered thereto, at one of two discrete and different landing areas on one side of the envelope 90. Each envelope 90 and its associated note sheet 40 thus form an article assembly 95, which are stacked as a stack 96. Although each envelope 90 bears a note sheet 40, the overall height of the stack 96 is reduced because the note sheets 40 of contiguous envelopes 90 are not in vertically overlapping relation. As discussed above with respect to the article assemblies 41 of FIGS. 2–6, the envelopes 90 and note sheets 40 may be preprinted, or blank as assembled, or some combination thereof In either event, the note sheets 40 are adhered on the envelopes 90 in registry with edges or images thereon to facilitate further processing. While the note sheets 40 are illustrated in FIG. 7 as applied to the flap side of the envelopes 90, the note sheets may be applied to either side, as desired and allowed by applicable postal standards.

Figure 8:
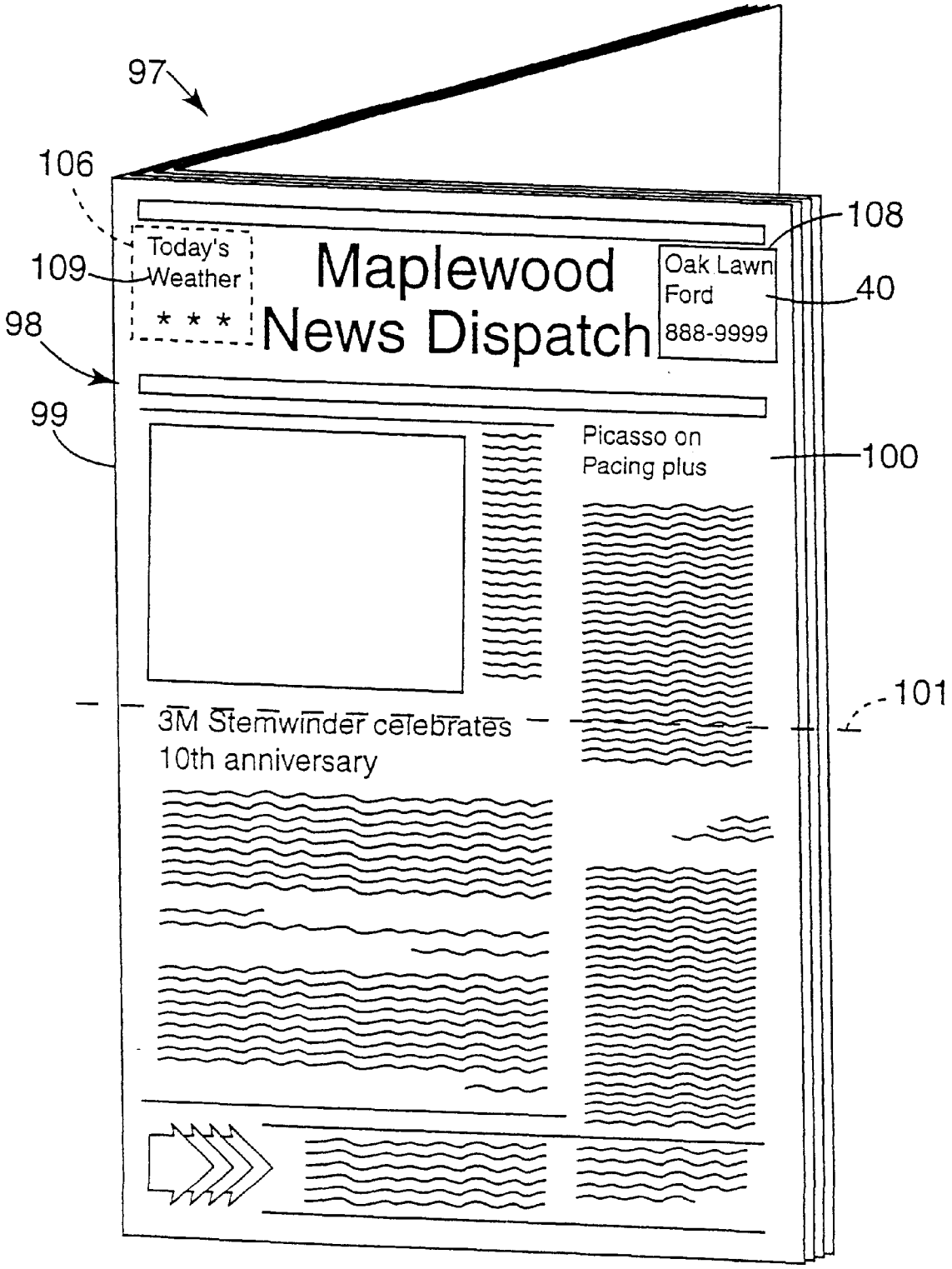
FIG. 8 illustrates, in perspective, an inventive article assembly wherein the underlying substrate is a newspaper.

FIG. 8 illustrates an article assembly 97 wherein the underlying substrate is a newspaper 98. An RPSA note sheet 40 is adhered to the newspaper 98, as shown. A typical newspaper is made up of one or more sections, with each section formed by a plurality of sheets which are laid together and folded (as at along fold 99). One such section is illustrated in FIG. 8, and has a front face or page 100. Typically, a newspaper is folded in half for transport and distribution laterally across its front page 100, as at fold line 101.

The use of such an RPSA note sheet on a newspaper allows the newspaper publisher to sell or otherwise utilize the space on the note sheet itself, as well as the space on the underlying front page of the paper. Alternating the placement position of RPSA note sheets on newspapers during production in a non-overlapping pattern on sequential papers allows at least some readers to immediately see the information which would be otherwise covered by the note sheet on other papers. Consequently, a newspaper publisher has the opportunity to maximize advertising space by selling advertisements in those locations where RPSA note sheets may be applied, since some papers will have that location exposed while others will have that same location covered by an RPSA note sheet (with an alternative location exposed). This non-overlapping arrangement is attained using multiple note sheet applicators on the newspaper production line, spaced laterally cross the line. Thus, the overall speed of the newspaper production line is not slowed, since multiple applicator heads are alternately applying note sheets to the stream of newspaper product passing thereby.

Figure 9:
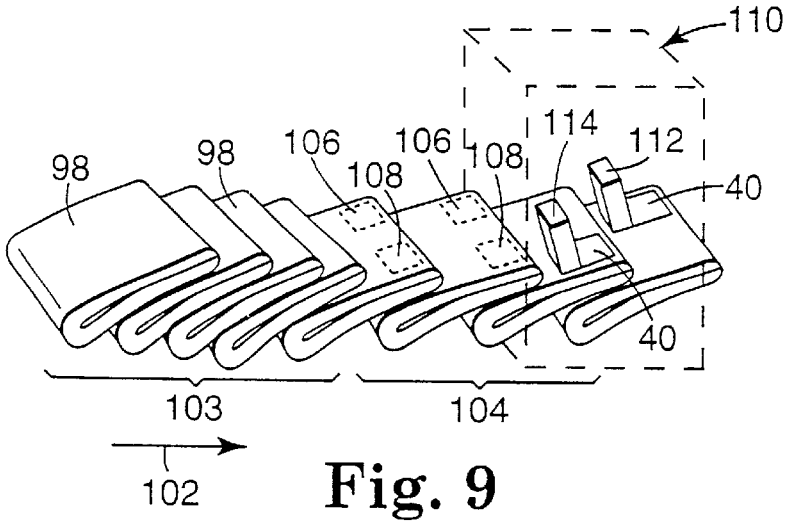
FIG. 9 schematically illustrates the application of note sheets to a series of shingled newspapers along a newspaper production conveying stream.
Figure 10:
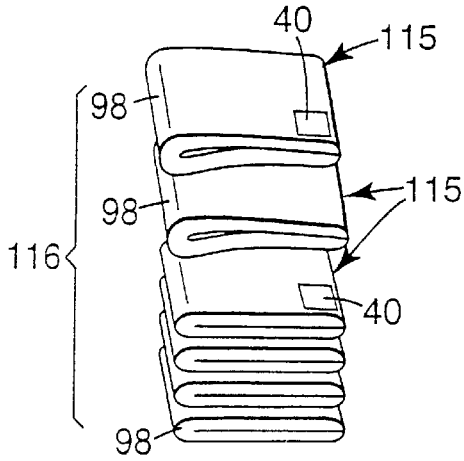
FIG. 10 illustrates a stack of newspapers produced in accordance with the process illustrated in FIG. 9.

This arrangement is more specifically illustrated in FIG. 9. Assembled and folded newspapers 98 are conveyed along a conveyor system in direction of arrow 102 (FIG. 9). The top half of the front page 100 of each newspaper 98 faces upwardly and the newspapers 98 are aligned and conveyed in a "shingled" arrangement, as at 103. The shingling of the newspapers 98 on the conveyor system is modified to diminish the overlap between adjacent newspapers 98 and expose more of the top half of the front page 100 of the newspaper, as at 104. Two discrete landing areas are exposed laterally across each newspaper 98, such as landing areas 106 and 108. The landing areas 106 and 108 on each newspaper 98 are different and do not overlap. As shown; they are adjacent the top edge of the front page 101 of the folded newspaper 98 (adjacent the masthead of the newspaper) in a prime viewing space for newspaper distribution either from news stands, newspaper vending machines or newspaper racks (where the newspapers are often placed in a shingled arrangement for sale). In FIG. 8, a note sheet 40 is shown as applied to the landing area 108 of the newspaper 98, while the landing area 106 has no note sheet thereon (and thus the indicia 109 printed on the landing area 106 of the front page 100 is exposed). Of course, the newspaper 98 will also have printing on the landing area 108, which will be visible once the note sheet 40 is removed.

As the expanded shingled newspapers 98 pass through a note sheet application station 110 (FIG. 9), a pair of laterally and longitudinally staggered note sheet applicators 112 and 114 sequentially apply note sheets 40 to the passing newspapers 98. Each note sheet applicator applies a note sheet on an alternating newspaper 98 as it passes thereby, with the note sheet applicator 112 applying note sheets 40 to landing area 106 and the note sheet applicator 114 applying note sheets 40 to landing area 108.

The newspaper bearing a note sheet thus defines a completed article assembly 115 which is then typically stacked for further distribution and transport. FIG. 9 illustrates a stack 116 of newspaper article assemblies 115 after accumulation in a suitable newspaper stacker apparatus. Often, such a stack 116 is bundled for ease of handling and secured with a wrap of twine or plastic material. Because of the thickness of each newspaper 98 itself, the addition of the note sheet 40 thereon adds no appreciable thickness to the stack 116. In this case, the thickness concern is not an issue for the finished article assemblies. Rather, it is a concern of selling advertising space and covering up the preprinted images already borne by the front page 100 of the newspaper 98 at its most prominent location (at the top of the front page 100 adjacent the masthead) and of providing a means for placing advertising note sheets 40 in the hands of consumers for further use as reminders or coupons, etc.

This note sheet application arrangement for newspapers has particular advantages in terms of speed of application. In some cases, newspapers are produced and advanced for further handling at a rate of up to 45,000 newspapers per hour. It is highly undesirable to slow down the newspaper production rate in order to apply labels or note sheets to the newspapers. Using the present inventive arrangement, folded newspapers can be advanced in a longitudinal direction at a rate of 45,000 newspapers per hour and repositionable pressure-sensitive adhesive note sheets can be applied using a pair of applicators to apply the note sheets each of which has a longitudinal dimension of about 3 inches (7.5 cm)). The application of repositionable pressure-sensitive adhesive note sheets onto shingled newspapers in this manner is contemplated with note sheets having a longitudinal extent ranging from 1 to 7 inches (2.5 cm to 7.8 cm).

EXAMPLES

Illustrative Example 1 (Prior Art Stack)

A stack was formed by attaching 250 three inch by three inch (7.5 cm by 7.5 cm) Post-it® brand note sheets (commercially available from Minnesota Mining and Manufacturing Company, St. Paul, Minn. to letter size (8½ inch by 11 inch or 21.6 cm by 27.9 cm) 20 lb. bond paper. The edges of each note sheet were aligned in parallel with its underlying carrier paper sheet, and two edges of each note sheet were within 0.125 inch (0.3 cm) of two edges of the underlying carrier paper sheet. An offset was formed by the difference between the highest and lowest points of the resultant stack of the paper sheets and note sheets attached thereto. The highest point was measured to be 2.1 inches (52 mm) along the corner of the stack having the note sheets adjacent thereto. The lowest point was measured to be 1.1 inches (28 mm) when measured along the opposite corner of the stack from that where the note sheets were attached, resulting in an offset of 1.0 inches (24 mm).

Illustrative Example 2 (Prior Art Stack)

A stack was formed as in Example 1, but of 500 assemblies (500 sheets of paper with RPSA note sheets attached). Five hundred assemblies is a common package in commercial printing, referred to as a "ream" of paper. The highest corner of the resultant stack was measured to be 4.1 inches (104 mm) and the lowest corner was measured to be 2.2 inches (56 mm), resulting in an offset of 1.9 inches (48 mm).

Example 3

A stack was formed as in Example 1, but of 100 assemblies (100 sheets of paper with RPSA note sheets attached).

However, alternating paper sheets were oriented as illustrated in FIG. 2. The measured highest point of the resultant stack was along one of the corners having note sheets attached adjacent thereto, and it was measured as 0.6 inches (16 mm). The lowest point of the stack was measured at a corner having no note sheets attached adjacent thereto, and it was measured as 0.4 inches (11 mm), resulting in an offset of only 0.2 inches (5 mm).

Example 4

A stack was formed as in Example 1, but of 100 assemblies (100 sheets of paper with RPSA note sheets attached). However, alternating paper sheets were oriented as illustrated in FIG. 5. The measured highest point of the resultant stack was along one of the corners of the stack (each corner having note sheets adhered thereto), and it was measured as 0.6 inches (14.5 mm). The lowest point of the stack was measured along the center of a long edge of the paper sheets in the stack, and it was measured to be 0.4 inches (11 mm), resulting in an offset of only 0.1 inches (3.5 mm).

Example 5

A series of 25 No. 10 envelopes were printed and sealed. A three-inch by three-inch (7.5 cm by 7.5 cm) Post-it® brand note sheet was adhered to each envelope, each note sheet having a strip of adhesive 0.5 inches (12.5 mm) wide along one edge and a strip of adhesive 0.25 inches (6.3 mm) wide along an opposite edge. The note sheets were applied to the envelopes as illustrated in FIG. 7, at two discrete landing area locations, and the resultant envelope and note sheet assemblies were stacked as shown in FIG. 7. The height of the resultant stack was measured as 1.0 inches (26 mm) on both corners along the envelope edge with the flap, and 1.0 inches (25 mm) along the other two corners of the envelope.

While illustrated only in the drawing figures as single sheets, envelopes or newspapers, the underlying workpiece to which a note sheet may be adhered may be any workpiece having a suitable surface for accepting a note sheet. This would include such items as advertising signatures, books, multifold brochures, boxes or even non-uniformly shaped articles. For purposes of this application, it is essential only that the article receiving the repositionable note sheet have a face suitable for the adherence of a repositionable sheet thereon.

The term "repositionable" means the note sheet can be adhered to and removed from a clean solid surface at least two times without substantially losing tack. Preferably, the sheet can be adhered to and removed from a clean solid surface at least ten, and more preferably, at least twenty times without substantially losing tack. The RPSA on a back face of the note sheet at least partially covers the back face thereof, and may be applied in any suitable pattern, adjacent only one edge of the note sheet, two edges or adjacent all four edges (in the case of a rectangular note sheet). Alternative shapes for the note sheet (other than rectangular) are also possible. Examples of the types of note sheets suitable for this application are further discussed in co-pending U.S. patent application Ser. No. 08/943,634, now U.S. Pat. No. 6,268,032, owned by the assignee of the instant application, 3M innovative Properties Company, and incorporated herein by reference.

Typically, an adhesive primer layer is applied to the back face of the note sheet, underlying the adhesive pattern thereon. If desired, a release coat may be applied to the workpiece landing area (or at least that portion of the landing area where the adhesive pattern will be affixed). Such primers and release coats for repositionable adhesives are well known, as are the repositionable adhesives themselves. RPSAs, associated primers and release layers are well known in the art, as evidenced by U.S. Pat. Nos. 5,045,569; 4,988,567; 4,994,322; 4,786,696; 4,166,152; 3,857,731; and 3,691,140; the disclosures of which are incorporated herein by reference. When the note sheet stock is provided in roll form, the top (non-adhesive bearing) side of the note sheet stock may also be coated with a release layer to facilitate the unwinding of the roll.

The note sheet stock material may be formed from paper sheeting, and is preferably an unsaturated paper (paper which is not impregnated with a resin). For a sheeting material which results in a cut note sheet similar to a Post-it® brand note sheet, the note sheet stock material is an opaque paper. Other note sheet stock material may be conventional bond or clay-coated paper, carbonless paper, a polymeric sheet material or even a metal foil. Further, transparent or translucent substrate materials (i.e., light-transmissive) such as those used for Post-it® brand tape flags sold by Minnesota Mining and Manufacturing Company, are also possible note sheet stock materials. A transparent or translucent substrate for the note sheet may also have indicia printed thereon. Furthermore, indicia printed on the article may be visible through the sheet material, and the indicia on the article and sheet material may overlap and be cooperatively aligned. The note sheet stock may also carry encapsulated fragrances, and indicia apply thereto may be represented by embossed or protruding areas (e.g., Braille for those with limited eyesight). In other words, the note sheet stock may bear any form of indicia which is detectable by the human senses, or is even only a machine readable indicia.

Although the present invention has been described with reference to preferred embodiments, workers skilled in the art will recognize that changes may be made in form and detail without departing from the spirit and scope of the invention. For example, multiple landing areas may be provided laterally across the face of a stream of moving articles, so that three or more note sheets may be applied thereto. In that case, the landing areas may even overlap in a lateral orientation. Such an arrangement will allow even more rapid deployment of note sheets on workpieces moving past the plurality of note sheet applicators.

What is claimed is:

1. A stack of identical article assemblies comprises:

a plurality of generally planar identical articles, each article having front and back opposite major faces and top and bottom edges; and a plurality of identical repositionable pressure sensitive adhesive sheets, each sheet comprising a backing layer and a repositionable pressure sensitive adhesive layer, each sheet being adhered in an identical location and orientation on the front major face of a respective one of the articles, wherein the back major face of each article in the stack lies on the front major face of the article therebelow, every other article in the stack is turned 180 degrees so that the top edge of each article in the stack extends along the bottom edge of the article therebelow, and the repositionable pressure sensitive adhesive sheets of contiguous articles are oppositely aligned and do not overlap.

2. The stack of identical article assemblies of claim 1 wherein each article is a single paper sheet.

3. The stack of identical article assemblies of claim 2 wherein each article is free of adhesive.

4. The stack of identical article assemblies of claim 2 wherein the backing layer of each repositionable pressure sensitive adhesive sheet has front and back opposite major faces, and wherein each backing layer has the repositionable pressure sensitive adhesive layer for its respective sheet partially coating the back face of the backing layer.

5. The stack of identical article assemblies of claim 1 wherein each article is free of adhesive.

6. The stack of identical article assemblies of claim 1 wherein the backing layer of each sheet has front and back opposite major faces, and wherein each backing layer has the repositionable pressure sensitive adhesive layer for its respective sheet partially coating the back face of the backing layer.

7. The stack of identical article assemblies of claim 1 wherein each article is an envelope.

8. The stack of identical article assemblies of claim 7 wherein the front major face of each article is a flap side of the envelope.

9. A stack of identical article assemblies comprises:

a plurality of generally planar identical articles, each article having front and back opposite major faces and top and bottom edges; and a plurality of identical repositionable pressure sensitive adhesive sheets, each sheet being adhered in an identical location and orientation on the front major face of a respective one of the articles, wherein the articles are aligned in stacked pairs, the back major face of one article in each pair lies on the front major face of the other article in that pair, one article in each pair is turned 180 degrees on a vertical axis with respect to the other article in that pair so that the top edge of one article extends along the bottom edge of the other article, and the repositionable pressure sensitive adhesive sheets of the articles in each pair are oppositely aligned and do not overlap, and wherein every other pair of articles is flipped over 180 degrees on a horizontal axis so that contiguous articles from adjacent pairs in the stack lie front major face to front major face and back major face to back major face, alternatively throughout the stack.

10. The stack of identical article assemblies of claim 9 wherein each article is a single paper sheet.

11. The stack of identical article assemblies of claim 10 wherein each article is free of adhesive.

12. The stack of identical article assemblies of claim 10 wherein each repositionable pressure sensitive adhesive sheet has front and back opposite major faces, and wherein each repositionable pressure sensitive adhesive sheet has repositionable pressure sensitive adhesive partially coating the back face of the repositionable pressure sensitive adhesive sheet.

13. The stack of identical article assemblies of claim 9 wherein each article is free of adhesive.

14. The stack of identical article assemblies of claim 9 wherein each sheet has front and back opposite major faces, and wherein each sheet has repositionable pressure sensitive adhesive partially coating the back face of the sheet.

15. A stack of article assemblies comprises:

a plurality of articles, each article having front and back opposite major faces and top and bottom edges, each front major face having a first surface area; and a plurality of repositionable pressure sensitive adhesive sheets, each sheet comprising a non-adhesive backing layer and a repositionable pressure sensitive adhesive layer, each sheet being adhered only to the front major face of a respective one of the articles, and each sheet having a second surface area, the second surface area of the sheet being less than the first surface area of the front major face of the respective article;

wherein the repositionable pressure sensitive adhesive sheets of contiguous articles in the stack are not aligned vertically.

16. The stack of article assemblies of claim 15 wherein each article is free of adhesive.

17. The stack of article assemblies of claim 15 wherein the backing layer of each sheet has front and back opposite major faces, and wherein the backing layer has the repositionable pressure sensitive adhesive layer for its respective sheet partially coating the back face of the backing layer.

18. The stack of article assemblies of claim 15 wherein each article is an envelope.

19. The stack of article assemblies of claim 18 wherein the front major face of each article is a flap side of the envelope.

20. The stack of article assemblies of claim 15 wherein each article is a single sheet of planar material.

* * * * *

UNITED STATES PATENT AND TRADEMARK OFFICE

CERTIFICATE OF CORRECTION

PATENT NO. : 6,544,640 B1
DATED : April 8, 2003
INVENTOR(S) : Miles, Alden R.

It is certified that error appears in the above-identified patent and that said Letters Patent is hereby corrected as shown below:

Title page,
Item [75], Inventors, delete after "Alden R. Miles", "St. Paul, MN (US)" and insert -- Lakeville, MN (US) -- and delete after "Timothy A. Mertens", "St. Paul, MN (US)" and insert -- Woodbury, MN (US) --
Item [57], ABSTRACT,
Line 5, insert -- . -- following "thereof".

Column 2,
Line 63, insert -- . -- following "thereof".

Column 4,
Line 36, delete "Of" and insert -- of --.

Column 8,
Line 66, insert -- . -- following "thereof".

Signed and Sealed this

Twenty-fifth Day of November, 2003

JAMES E. ROGAN
*Director of the United States Patent and Trademark Office*